United States Patent [19]

Limousin

[11] 4,341,057

[45] Jul. 27, 1982

[54] WRAPPING MACHINE

[75] Inventor: Jean-Louis Limousin, Clearwater, Fla.

[73] Assignee: Pet, Inc., St. Louis, Mo.

[21] Appl. No.: 160,615

[22] Filed: Jun. 18, 1980

Related U.S. Application Data

[63] Continuation of Ser. No. 944,858, Sep. 22, 1978, abandoned.

[51] Int. Cl.[3] ..... B65B 11/10

[52] U.S. Cl. ..... 53/553; 53/229; 53/586; 53/373

[58] Field of Search ..... 53/450, 466, 463, 137, 53/228, 233, 296, 397, 550, 552, 553, 554, 580, 586, 373, 229; 474/900

[56] References Cited

U.S. PATENT DOCUMENTS

| | | | |
|---|---|---|---|
| 1,801,043 | 4/1931 | Harber | 474/900 |
| 2,650,505 | 9/1953 | Vannatta | 474/900 |
| 2,767,535 | 10/1956 | Bentley | 53/586 |
| 2,828,590 | 4/1958 | Swartz | 53/553 X |
| 3,097,462 | 7/1963 | Langdon | 53/553 |
| 3,465,489 | 9/1969 | Monaghan | 53/450 |
| 3,466,843 | 9/1969 | Mumper | 53/66 |
| 3,513,629 | 5/1970 | Hoagland et al. | 53/550 |
| 3,672,120 | 6/1972 | Heinzer | 53/550 |
| 3,782,072 | 1/1974 | Serensen | 53/553 X |
| 3,943,686 | 3/1976 | Crawford | 53/550 X |

FOREIGN PATENT DOCUMENTS

| | | | |
|---|---|---|---|
| 1489395 | 10/1977 | United Kingdom | 53/553 |

*Primary Examiner*—John Sipos

*Attorney, Agent, or Firm*—Frijouf, Rust & Pyle

[57] ABSTRACT

A device for wrapping a sheet material about an object is disclosed such as a heat shrinkable plastic material about a container in a shrink bundling process. The device is able to cover both the top and the bottom of the container or in the alternative cover only the top of the container with the use of auxiliary glue guns. The device comprises a frame having a conveyor for moving the container. A first sealing member includes a plurality of sealing elements rotatably mounted on a hub which is journaled to the frame. A second sealing member is slidably mounted to the frame for cooperation with one of the plurality of sealing elements. The sheet material extends between the first and second sealing members whereat the second sealing member engages a first of the plurality of sealing elements to sever the sheet material at the leading edge of the object. Rotation of the first sealing member positions a second of the plurality of sealing elements adjacent the second sealing member. The second sealing member and the second of the plurality of sealing elements sever the plastic material at the trailing edge of the object. The invention also resides within the method of wrapping an object with sheet material. The foregoing abstract is merely a resume of one general application, is not a complete discussion of all principles of operation or applications, and is not to be construed as a limitation on the scope of the claimed subject matter.

9 Claims, 20 Drawing Figures

FIG. 1
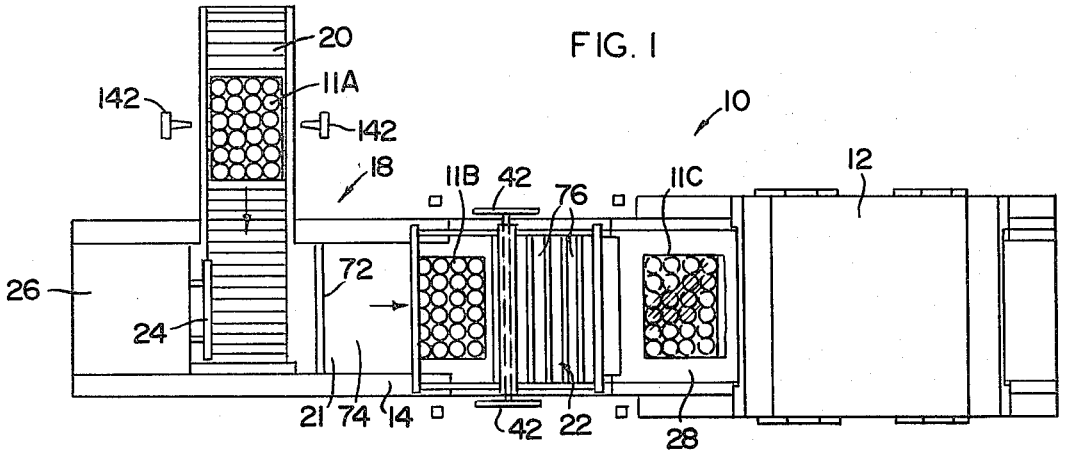
FIG. 2
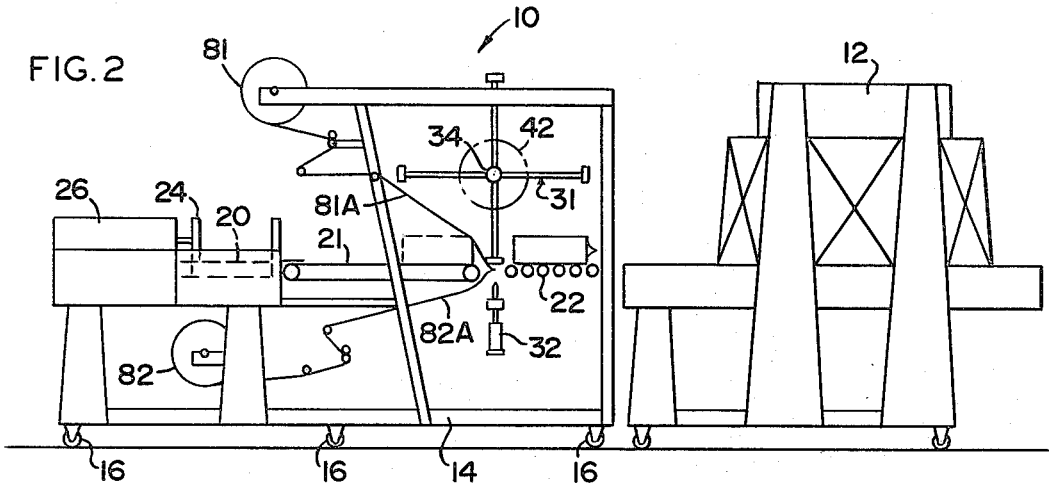
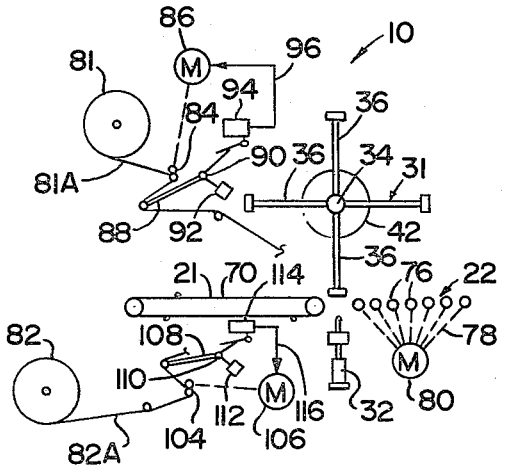
FIG. 3
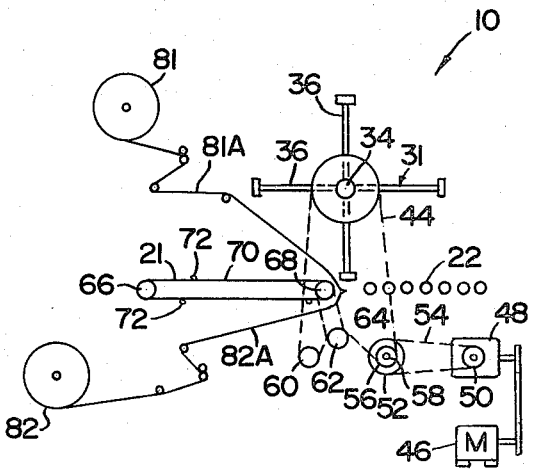
FIG. 4

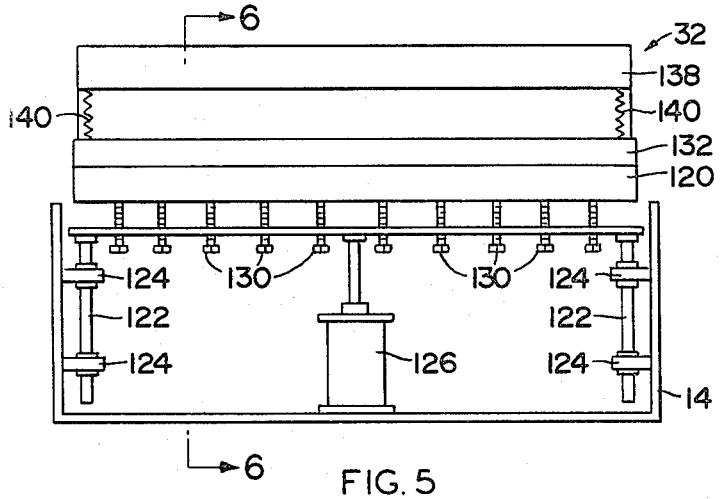
FIG. 5
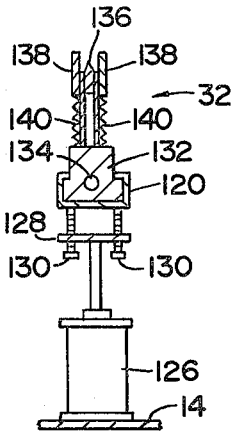
FIG. 6
FIG. 7
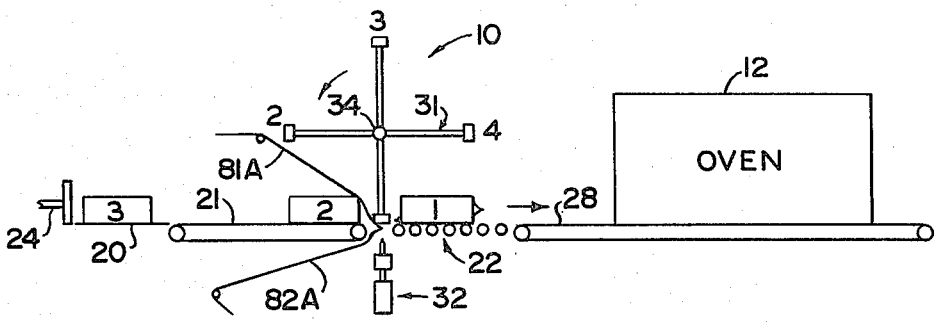
FIG. 8
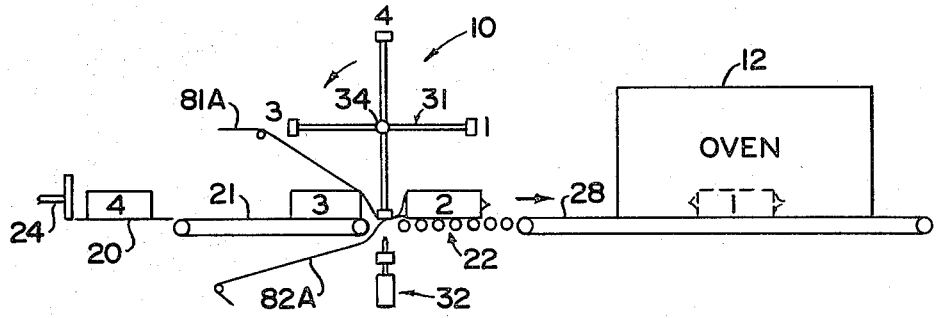
FIG. 9
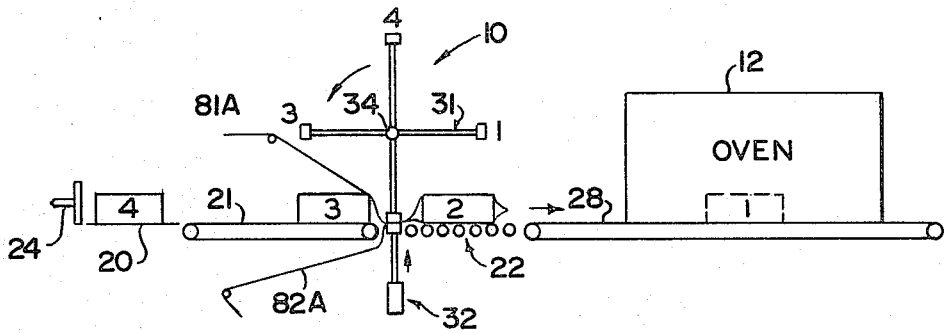

FIG. 14
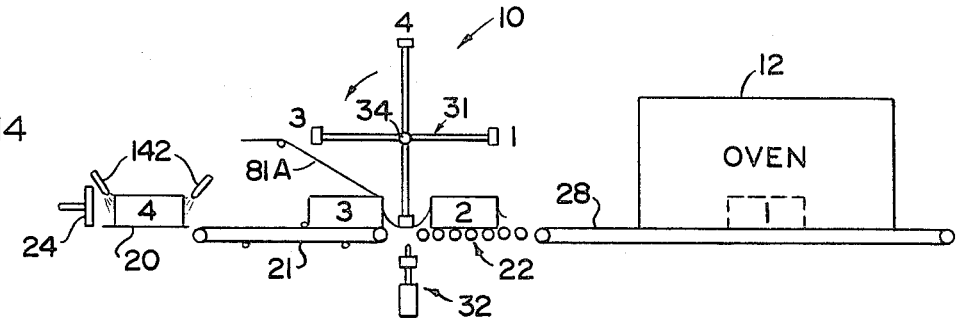
FIG. 15
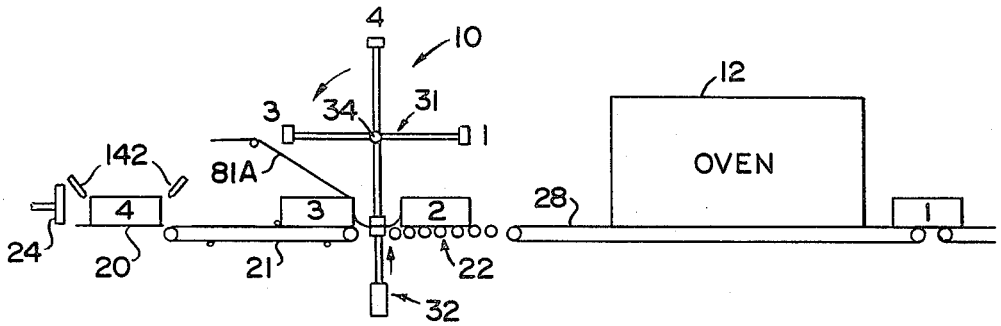
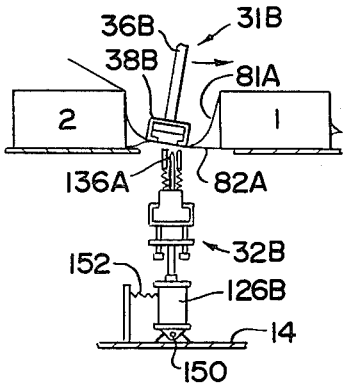
FIG. 18
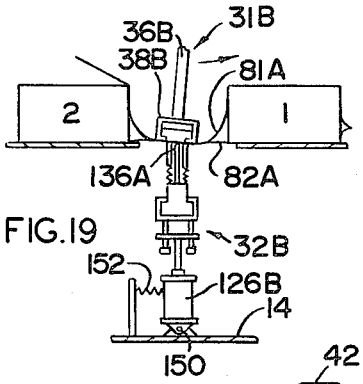
FIG. 19
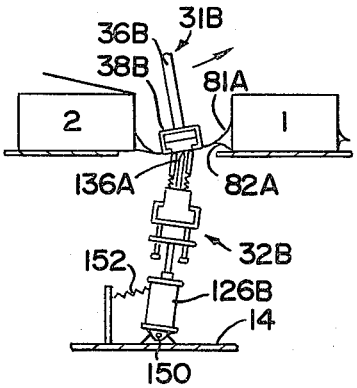
FIG. 20
FIG. 16
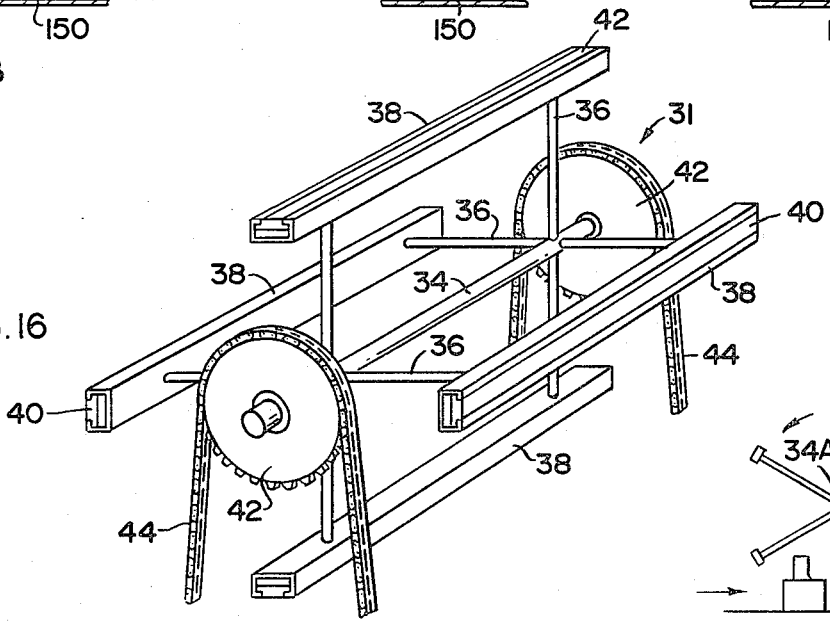
FIG. 17
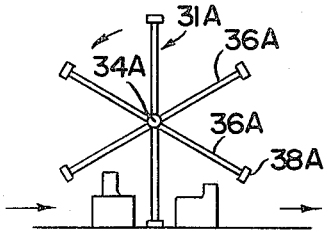

WRAPPING MACHINE

This is a continuation of application Ser. No. 944,858 filed Sept. 22, 1978 now abandoned.

BACKGROUND OF THE INVENTION

1. Field of the Invention

This invention relates to packaging machines and more particularly to machines for wrapping an object with a sheet material.

2. Description of the Prior Art

In recent years, the art of packaging and containerizing items has made substantial advances and has produced highly sophisticated machines for accomplishing various packaging tasks. In general, the art attempts to package items in a more superior fashion and at a more economical price. The cost of packaging is generally determined by two factors. The first factor is the material cost involved in packaging the item. Accordingly, the art attempts to reduce the amount of material or to substitute a less expensive material without sacrificing packaging quality or strength. The second factor for providing an economical package is the packaging operating costs involved in actually packaging the object. In general, the packaging or containerization of an item or container is done automatically by machine. Accordingly, the packaging operating cost is primarily determined by the rate at which the machine can be operated and the initial cost of the packaging machine.

One of the more popular methods of packaging is through the use of a heat shrinkable plastic material. In general, there are two types of heat shrinkable plastic packages. The first package involves wrapping the item about two sides with the sheet material extending over the top and under the bottom of the container. The container is then passed through a heated region whereat the material shrinks to conform to the outer configuration of the container. The second package uses the heat shrinkable plastic material on only two sides and the top of the item. The second type package saves approximately one-half of the material cost over the first package.

The art has developed various machines for wrapping an object with a heat shrinkable sheet material for a heat shrink packaging process. Unfortunately, the machines of the prior art have not satisfied the existing needs of the art. In general, the prior art machines are only able to accommodate a specific size container. If a different size container is to be packaged, substantial modification and adjustment of the machine is required prior to the efficient operation of the device. In addition, the prior art has not developed a machine which is compatible for use with both the full wrap of heat shrinkable material and the upper wrap of heat shrinkable material of the container. A further disadvantage of the prior art machines was the relatively slow operation speed.

Therefore it is an object of this invention to provide an apparatus which overcomes the aforementioned inadequacies of the prior art devices and provides an improvement which is a significant contribution to the advancement of the packaging art.

Another object of this invention is to provide a device for wrapping a sheet material about a portion of an object comprising a sealing member having a plurality of sealing elements rotatably mounted about a common hub wherein the sealing material is draped over the object between two adjacent sealing elements.

Another object of this invention is to provide a device for wrapping a sheet material about an object comprising a first sealing member having a plurality of sealing elements rotatably mounted about a common axis in combination with a second sealing member slidably mounted for reciprocal movement in a direction along a line extending through the common axis.

Another object of this invention is to provide a device for wrapping a sheet material about an object which device is capable of simultaneously wrapping the sheet material over the upper region and the bottom region of the object. The device may be quickly modified to dispose the sheet material over only the two opposed sides and the upper region of the object.

Another object of this invention is to provide a device for wrapping a sheet material about an object incorporating a heat sealing means removably mounted to a subframe for enabling rapid interchange of the heat sealing means in the event of failure of the heat sealing element.

Another object of this invention is to provide a method of wrapping a sheet material about a portion of an object which results in superior performance over the prior art machines.

Another object of this invention is to provide a device for wrapping a sheet material about an object which device can be economically operated and easily cleaned for wrapping food products.

Another object of this invention is to provide a method of wrapping a sheet material about a portion of an object which increases the productivity relative to the prior art machines.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims, taken in conjunction with the accompanying drawings.

SUMMARY OF THE INVENTION

The invention may be incorporated into a device for wrapping a sheet material such as a heat shrinkable plastic material about a portion of an object, such as a container or the like. The container may be a symmetric object such as an ice cream container or may be an irregular object for example, a case of can goods or the like. Although the device is disclosed as an apparatus for wrapping a heat shrinkable material, it should be understood that use is merely set forth for purposes of illustrating the invention and should not be construed as limiting the scope of the new improved wrapping device.

The device comprises a frame including conveyor means for conveying the object along the device. A first sealing member comprising a plurality of sealing elements is rotatably mounted about the common axis relative to the frame. A second sealing member is mounted relative to the frame for cooperation with one of the plurality of first sealing elements of the first sealing member. Means are provided for storing the sheet material to extend the sheet material in proximity to the first and second sealing members. A conveyor drive means is positioned for driving the conveyor means to move the object relative to the first and second sealing members. A first sealing member drive means rotates the first sealing member to position one of the plurality of sealing elements to be adjacent the second sealing member. A second sealing member drive means establishes relative movement between the first and second sealing members for sealing the sheet material about the object.

In a more specific embodiment of the invention, the conveyor means comprises a slide and push bar means for pushing the object along the slide. The push bar may comprise a first and a second rotatable means mounted at opposite ends of the slide. Flexible means, such as a belt or a chain interconnects the first and the second rotatable means with the push bar being mounted to the flexible means for pushing the object on the slide upon rotation of the first and second rotatable means.

In another example of the invention, the conveyor means includes a first and a second conveyor disposed on opposite sides of the sealing members. The first conveyor comprising a push bar and a slide is disposed to move the object toward the first and second sealing member. The second conveyor may comprise a plurality of rollers disposed to move the object away from the first and second sealing members.

The first sealing member may take the form of a central hub rotatably mounted to the frame with a plurality of arms extending from and uniformly distributed about the central hub. The sealing elements of the first sealing member are secured to the terminal end of the plurality of arms. Each of the sealing elements may comprise a sealing block having a release agent located thereon. In a preferred form of the invention, the sealing member drive means comprises a motor driving an eccentric means such as an eccentric cam, pulley or a sprocket. The eccentric means is connected for rotating the first sealing member in accordance with the eccentric speed of the eccentric means. The motor may be connected for simultaneously powering the conveyor drive means and the first sealing member drive means.

The second sealing member in a preferred example of the invention is movably mounted to the frame for linear movement along a line with the axis of rotation of the first sealing member. The second sealing drive means may include an air cylinder for reciprocally moving the second sealing member. The second sealing means comprises a subframe slidably mounted to the frame. A heater block is removably mounted to the subframe with a heat sealing bar extending from the heater block for sealing and severing the sheet material. Spring biased gripper elements are disposed on opposed sides of the sealing bar for gripping the sheet material against one of the sealing elements of the first sealing member.

The device is capable of storing a first and a second sheet on a first and a second reel located on opposite sides of the conveyor. In this example, the sheet is secured to the upper and the lower regions of the object. In the alternative, a single reel may be employed for covering only the upper region of the object. Glue gums are provided for attaching the sheet material to opposed sides of the object for affixing the sheet material to the upper surface of the object.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a plan view of a device for wrapping a sheet material about an object;

FIG. 2 is a side elevational view of the device shown in FIG. 1;

FIG. 3 is a partial view of the mechanism of the machine shown in FIGS. 1 and 2;

FIG. 4 is a diagram showing the drive mechanism of the first sealing member and the first conveyor means;

FIG. 5 is an elevational view of the second sealing member and the second heat sealing member drive means;

FIG. 6 is a sectional view along line 6—6 of the heat sealing member and drive means shown in FIG. 5;

FIG. 7 is a first step of a first method of wrapping a sheet about an object within first and second sheets are joined to extend between a first and a second object;

FIG. 8 is a second step of a first method of wrapping a sheet about an object wherein the second object has advanced with the first and second sheet being interposed between the second and a third object;

FIG. 9 is a third step of a first method of wrapping a sheet about an object wherein the sheets extending from the trailing edge of the second object is sealed and severed;

FIG. 14 is a fourth step in the second method of wrapping an object with a sheet wherein the second object has been advanced to press the sheet material against the trailing edge of the second object;

FIG. 15 is a fifth step of the second method of wrapping an object with a sheet wherein the sheet material is severed between the second and a third object;

FIG. 16 is an isometric view of the first sealing member in greater detail;

FIG. 17 illustrates a variation of the device shown in FIGS. 1–16;

FIG. 18 illustrates a first step in a third method of wrapping an object with a sheet wherein a first sealing element of the first sealing member is adjacent to the second sealing member;

FIG. 19 is a second step of a third method of wrapping an object with a sheet wherein the second sealing member engages the first sealing element; and FIG. 20 is a third step of a third method of wrapping an object with a sheet wherein both the first and second sealing members move in unison about respective pivotable axes.

Similar reference characters refer to similar parts throughout the several views of the drawings.

DETAILED DESCRIPTION

Figure 10:
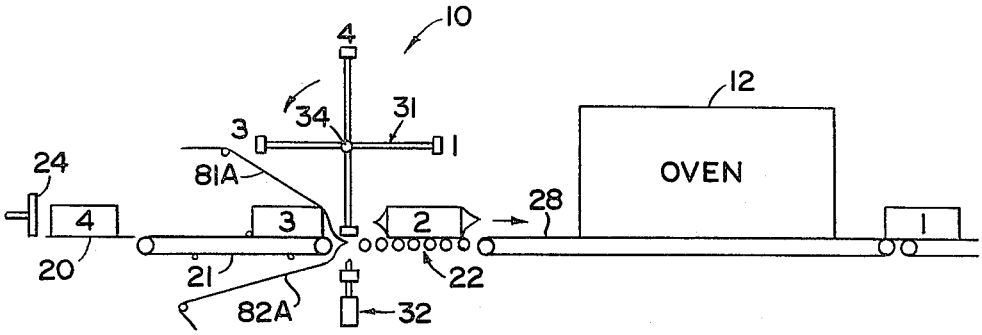
FIG. 10 is a fourth step of a first method of wrapping a sheet about an object wherein the second object is conveyed by conveyor means to an oven.

FIGS. 1 and 2 illustrate a device 10 for wrapping a sheet material about at least a portion of an object shown as a carton of canned products 11. The device 10 may be designed for use with an oven 12 in a manner which will be hereinafter described. The device 10 comprises a frame 14 preferably mounted on rollers 16 for supporting conveyor means shown generally as 18. A side conveyor 20, which may be a conventional belt conveyor moves the object 11A downward in FIG. 1 as indicated by the arrow. The conveyor means 18 also comprises a first conveyor 21 and a second conveyor 22 for moving the objects 11 through the sequence of the device 10. The side conveyor 20 preferably moves the object 11A in a downward position whereat a pusher 24 powered by means enclosed in housing 26, moves the object 11A to the first conveyor 21. Pusher 24 is activated by sensing means (not shown) such as a microswitch, photo-optical means or the like. The first conveyor 21 moves the object 11A for wrapping by the device 10. The wrapped object 11C is moved by the second conveyor 22 to a conveyor 28 of oven 12.

The internal mechanism of the device 10 is more fully shown in FIGS. 3–6 and 16 and includes a first sealing member 31 and a second sealing member 32. The first sealing member 31 is rotatably mounted on a shaft or a hub with a plurality of arms 36 extending from and uniformly distributed about the shaft 34. A plurality of sealing elements 38 are secured to the terminal ends of the plurality of arms 36. The sealing elements 38 comprise a sealing block having a release agent 40 located therein as shown in FIG. 16. The shaft 34 is driven by plural sprockets 42 which are powered by chains 44.

FIG. 4 illustrates a motor 46 for driving a speed reduction box 48 with an output sprocket 50 of the speed reduction box 48 driving an eccentric sprocket 52 by a chain 54. Eccentric sprocket 52 and a sprocket 56 are secured to a common shaft 58 which shaft moves in accordance with the rotation of eccentric sprocket 52. Chain 44 engages sprocket 56 in addition to engaging sprocket 60 and idler sprocket 62. Idler sprocket 62 is preferably biased by means (not shown) to maintain a constant tension on chain 44. A second sprocket rotates with sprocket 62 to drive a chain 64 for powering the first conveyor 21.

The first conveyor 21 includes plural rotating means 66 and 68 with a flexible member 70 such as a chain or belt moving in accordance with the rotatable means 66 and 68. A plurality of pushbars 72 are secured to the flexible members 70 for pushing the containers along a slide 74 shown more fully in FIG. 1. Accordingly, in this embodiment, both the first sealing member 31 and the first conveyor 21 are driven by a common motor 46 in a common eccentric or variable speed motion.

FIG. 3 illustrates other structures of the device including the drive of the second conveyor 22. The second conveyor 22 includes a plurality of rollers 76 each driven by a belt 78 powered by a motor 80.

A sheet storage means is shown as a first and a second reel 81 and 82 located above and below the first conveyor 21. It should be understood that various other arrangements and locations of sheet storage means may be utilized with the present invention. An upper or first sheet 81A extends from first reel 81 through a drive and idler roller 84 powered by a motor 86. A tension sensor 88 is mounted on pivot 90 with a counterweight 92. The position of tension sensor 88 activates a switch 94 for controlling the motor 86 through a conductor 96. As the tension increases on the sheet 81A from the first sealing member 31, the tension sensor 88 rotates counterclockwise and activates switch 94 thereby energizing motor 86. Motor 86 drives the first sheet material 81A from reel 81 to supply the sheet material to the first and second sealing members 31 and 32. A second sheet 82A similarly extends from the second reel 82 through a drive and idler roller 104 powered by a motor 106. Tension sensor 108 is mounted on pivot 110 with counterweight 112. Microswitch 114 control motor 106 through conductor 116.

FIGS. 5 and 6 show the second sealing member 32 in greater detail. The second sealing member 32 comprises a subframe 120 slidably mounted by shafts 122 and guides 124 to frame 14 of the device 10. An air cylinder 126 moves the subframe 120 linearly on shafts 122 and guides 124. A support bar 128 receives a plurality of threaded adjustment screws 130 for adjusting the orientation of a heater block 132 relative to the frame 14. The heater block 132 has an internal heater 134 for heating a sealing bar 136. Plural gripper jaws 138 are located on opposite sides of the sealing bar 136 and are biased by springs 140 to extend outwardly relative to the heater block 132. Activation of air cylinder 126 will first cause engagement of the terminal ends of gripper jaws 138 with one of the sealing elements 36 and more specifically the release agent 40 of the first sealing member 31. Continued movement by air cylinder 126 causes the sealing bar 136 to engage the sheet material between the terminal end of the sealing bar 136 and the release agent 40.

The operation of the apparatus heretofore described and the novel method of wrapping an object will be described in reference to FIGS. 7–10. FIG. 7 illustrates a first object 1 being transferred by the second conveyor 22 to the oven 12 after having the sheet material 81A and 82A disposed on the upper and bottom regions of the object 1. The sheets 81A and 82A are joined in front of a second object 2. A third object 3 is positioned on the side conveyor 20.

FIG. 8 shows the result of indexing first sealing member 31 ninety degrees in a counterclockwise direction. The numerals at the terminal ends of the sealing elements of the first sealing member 31 indicate the position of the first sealing member 31 in the FIGS. The second object 2 is located on the second conveyor 22 whereas a third object 3 is resting on the first conveyor 21. A second of the plurality of sealing elements of the first sealing member 31 is now adjacent the second sealing member 32. A fourth object 4 is positioned on side conveyor 20. The first object 1 is disposed in oven 12. Rotation of first sealing means 31 has draped the sheet material 81A and 82A about the second object 2.

FIG. 9 shows the activation of air cylinder 126 raising the sealing bar 136 into engagement with the second sealing element of the first sealing member 31. The first and second sheets 81A and 82A are sealed and severed between the second and third objects 2 and 3. FIG. 9 also illustrates the effect of the oven 12 on the first object 1 causing the material to shrink into conformity with the outer configuration of the first object 1.

In FIG. 10, the second conveyor 22 is activated thereby conveying the second object 2 to the oven 12. In the next sequence, first sealing member 31 will again rotate ninety degrees as in FIGS. 7 and 8 to continue the process of wrapping the objects. The apparatus and process shown in FIGS. 7–10 illustrate a novel method and apparatus for wrapping objects of various configurations. As long as the object can be disposed between adjacent sealing elements 38 the objects can be easily wrapped. In the embodiment shown in FIGS. 7–10, the first sealing member 31 stops prior to activation of the second sealing member 32. Accordingly, the eccentric sprocket 52 which drives the first sealing member 31 and the first conveyor 21 reduces the stress on the sheets 81A and 82A. This apparatus and process is desirable when the object is to be wrapped on both the upper region and the lower region of the object.

FIGS. 11–15 illustrate a second method and apparatus for wrapping a sheet about at least a portion of an object. In this method, only the upper region of the object is to be covered by the sheet material. The process and apparatus shown in FIGS. 11–15 incorporates a different control sequence than the process shown in FIGS. 7–10. The apparatus set forth in FIGS. 1–6 and 16 may include an optional control circuit for providing either of the functions set forth in FIGS. 7–15.

Figure 11:
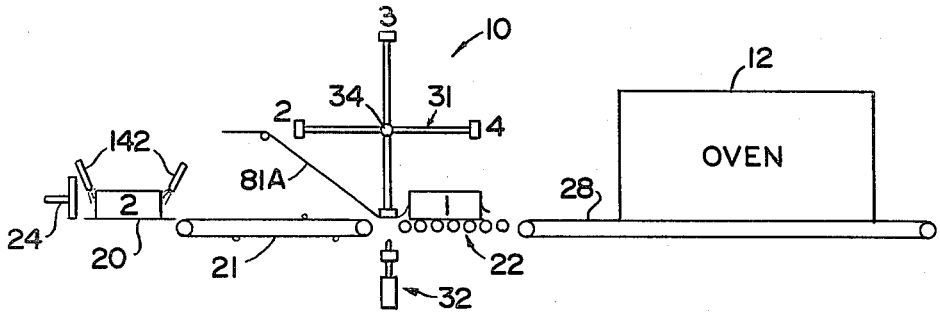
FIG. 11 is a first step in a second method of wrapping a sheet about an object wherein the sheet material is pressed against the trailing edge of a first object.

FIG. 11 illustrates the first step wherein glue guns 142 spray the leading and trailing edges of a second object 2 with an adhesive on side conveyor 20. The first sheet 81A is glued to both the leading and trailing edges of the first object 1. In this embodiment, the first conveyor 21 operates independently of the first sealing member 31. In FIG. 11, the first sealing member 31 is stopped at rest while the second object 2 is receiving glue from glue guns 142.

Figure 12:
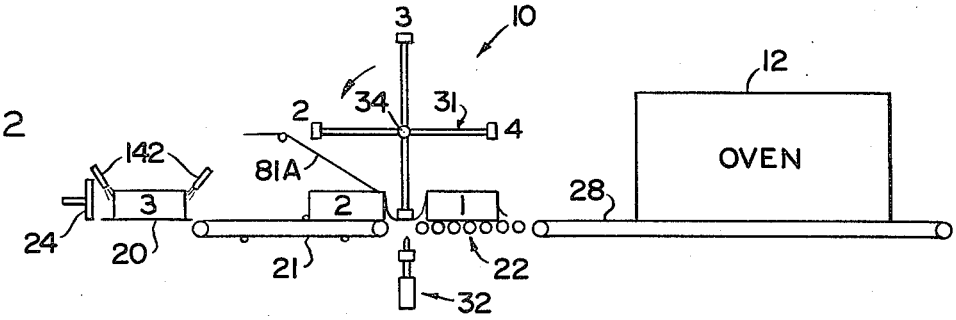
FIG. 12 is a second step in the second method of wrapping an object with a sheet wherein a second object is abutted against the sheet material to glue the sheet to the leading edge of the second object.

FIG. 12 shows the second step in the second method of wrapping the object. The first conveyor 21 has moved the second object 2 into contact with the first sheet 81A thereby gluing the first sheet 81A to the leading edge of the second object 2. The first sealing member 31 has not been displaced from the position as shown in FIG. 11. A third object 3 is receiving glue from glue guns 142.

Figure 13:
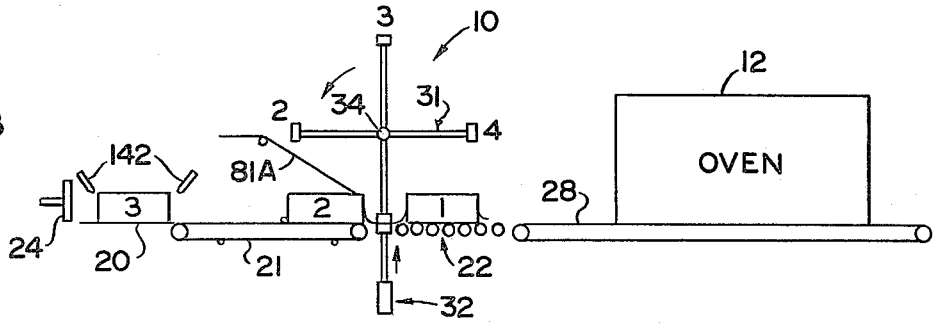
FIG. 13 is a third step in the second method of wrapping an object with a sheet wherein the sheet material is severed between the first and second objects.

FIG. 13 shows activation of the second sealing member 32 to sever the sheet 81A between the first and second objects 1 and 2.

FIG. 14 shows the result of a ninety degree rotation of the first sealing member 31. The second of the plurality of sealing elements 38 press the first sheet 81A against the trailing edge of the second object 2. The first sealing member 31 remains stationary as the first conveyor 21 conveys the third object 3 to abut the first sheet 81A thereby gluing the leading edge of the third object to sheet 81A. Concomitantly therewith, a fourth object 4 receives glue while the first object 1 is processed through oven 12.

FIG. 15 shows activation of the second sealing member 32 to sever the sheet 81A between the second and third objects 2 and 3.

The apparatus shown in FIGS. 1–4 and 16 need only be supplied with glue guns 142 and an independent drive of the first sealing member 31 and the first conveyor 21. The device 10 can accommodate both of the popular types of shrink wrapping now used in the art. The prior art required two separate and distinct machines for accomplishing these two distinct wrapping capabilities.

FIG. 17 illustrates a variation of the invention shown in FIGS. 1–16 comprising a first sealing member 31A having six arms 36A with sealing elements 38A at the terminal ends thereof. It should be appreciated that this arrangement may be incorporated where the objects to be wrapped are of smaller size. In addition, one or more of the six arms 36A may be removed for wrapping a large object which may not be accommodated between the angle subtended by the six extending arms 36A. Accordingly, a process may have to wrap three distinct size objects in a sequence. Accordingly, the angle between the arms 36A may be varied by appropriate means to wrap three sequential objects of varying size.

FIGS. 18–20 illustrate still another variation of the invention shown in FIGS. 1–17. In this embodiment, the second sealing member 32B including the air cylinder 126B is mounted on a pivot 150. A biasing spring 152 coacts between the second sealing member 32 and the frame 14 to urge the second sealing member 32B into the position shown in FIG. 18.

FIG. 19 shows movement of the arm 36B of the first sealing member 31B and activation of air cylinder 126B with sealing bar 136B contacting the sealing element 38B with the sheets 81A and 82A disposed therebetween. Continued movement of arm 36B of the first sealing member 31B causes rotation of the second sealing member 32B about pivot 150 as shown in FIG. 20. Concomitantly therewith, seal bar 136B seals and severs the first and second sheets 81A and 82A. The deactivating of air cylinder 126B enables bias spring 152 to return the second sealing member 32B to the position shown in FIG. 18. This modification enables the sealing and severing of the first and second sheets 81A and 82A during rotation of the first sealing member 31B. The eccentric sprocket 52 heretofore described, may be incorporated to slow the movement of the first sealing member 31B during the sealing processes outlined in FIGS. 18–20. Accordingly the first sealing member 31 need not be stopped to seal and sever the sheet material. The use of the sealing process shown in FIGS. 18–20 provides an improved performance over the prior art machines.

The foregoing has described the various features of the new and improved invention for wrapping a sheet about an object. The machine has been described as an L-shaped machine having a side conveyor and a first and a second linear conveyor. It should be understood that the machine finds application for both linear and L-shaped machines. It is the critical combination of the first and second sealing members which is considered to be the substantial improvement in the art.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. A machine for wrapping heat sealable sheet material about at least a portion of an object, comprising:

a conveyor having a forward terminal end, the conveyor establishing a transport path in a given direction to continuously move said object;

a first sealing member on one side of said path having a central hub, a plurality of discrete arms each extending from the hub to a terminal end and a sealing element carried by each of the terminal ends;

means mounting and continuously driving the first sealing member to rotate the terminal end sealing elements in a path substantially aligned with and tangential to the transport path for sequentially placing the sealing elements at a work station aligned with the transport path in space beyond the conveyor terminal end;

a second sealing member on opposite side of said path with a sealing element;

passive means for mounting the second sealing member to permit the sealing element thereof to swing through an arcuate segment path; the passive means lacking integral driving means for advancing the second sealing member;

means for moving the element of the second sealing member in substantially perpendicular direction to said transport path into and out of contact with a sealing element of said first sealing member in the work station, the second sealing element being pulled along in said arcuate segment path in said direction due to only its contact with and the continuous movement of the element of the first sealing member;

means urging the second sealing member in a direction opposite to said given direction to a position aligned with the work station whereby the second sealing member will return after the first sealing means loses contact therewith;

means for directing a supply of the sheet material in descending alignment over the conveyor to the work station;

one of the sealing members presenting a heated fuser element for sealing and severing said heat sealable sheet upon contact of said first and second sealing elements;

control means for driving the conveyor, for rotating said first sealing member and for moving the element of said second sealing member in a programmed sequence to bring the sealing elements into working contact at the work station when each terminal sealing element of the first sealing member is positioned in the work station whereby the sheet material is tucked over the object by the cooperative action of two sequential arms of the first sealing member, and a series of objects may flow through the work station uninterrupted and the sheet material in severed in proportion to the object size.

2. A machine for wrapping material about at least a portion of an object, as defined in claim 1, wherein the means driving the first sealing member comprises eccentric means for rotating the first sealing member in an eccentric speed relationship whereby the speed of rotation of said central hub is reduced when one of said plurality of arms is in proximity to said second sealing member enabling proper indexing therebetween.

3. A device as set forth in claim 1, wherein said conveyor means comprises a slide; and push bar means for pushing the object along said slide.

4. A device as set forth in claim 3, wherein said push bar means comprises a first and a second rotatable means mounted at opposed ends of said slide;

flexible means interconnecting said first and second rotatable means; and said push bar being mounted to said flexible means for pushing the object upon rotation of said first and second rotatable means.

5. A device as set forth in claim 1, wherein said second sealing member drive means includes an air cylinder.

6. A device as set forth in claim 1, wherein said second sealing member including a heated sealing bar for sealing and severing the sheet material between said heat sealing bar and one of said sealing elements.

7. A device as set forth in claim 6, including spring bias gripper elements for gripping the sheet material on opposed sides of said heat sealing bar.

8. A device as set forth in claim 7, including means for adjusting the location of said heat sealing bar along the length thereof.

9. A device as set forth in claim 6, including spring biased gripper elements disposed on opposed sides of said heat sealing bar for gripping the sheet material against one of said sealing elements of said first sealing member.

* * * * *

UNITED STATES PATENT AND TRADEMARK OFFICE

CERTIFICATE OF CORRECTION

PATENT NO. : 4,341,057

DATED : July 27, 1982

INVENTOR(S) : Jean-Louis Limousin

It is certified that error appears in the above-identified patent and that said Letters Patent is hereby corrected as shown below:

Col. 3, line 66, "gums" should be --guns--.

Col. 6, line 26, "control" should read --controls--.

Col. 10, line 11, "in" (first occurrence) should be --is--.

Signed and Sealed this

*Third* Day of *May 1983*

[SEAL]

*Attest:*

GERALD J. MOSSINGHOFF

*Attesting Officer*

*Commissioner of Patents and Trademarks*